United States Patent [19]

Sedley

[11] 3,995,460

[45] Dec. 7, 1976

[54] MAGNETIC CARD KEY OPERATED DOOR LOCK STRUCTURE

[76] Inventor: Bruce S. Sedley, 7 Murray Ave., Larkspur, Calif. 94939

[22] Filed: May 30, 1975

[21] Appl. No.: 582,125

[52] U.S. Cl. ..... 70/210; 70/215; 70/276; 70/387; 70/389; 70/413

[51] Int. Cl.[2] ..... E05B 13/10; E05B 35/14; E05B 47/00; E05B 63/00

[58] Field of Search ..... 70/210, 215, 276, 387, 70/389, 216, 413

[56] References Cited

UNITED STATES PATENTS

| | | | |
|---|---|---|---|
| 440,069 | 11/1890 | Stein | 70/46 |
| 2,732,703 | 1/1956 | Noregaard | 70/211 |
| 3,633,393 | 1/1972 | Hisatsune | 70/276 |
| 3,834,197 | 9/1974 | Sedley | 70/38 C |
| 3,837,195 | 9/1974 | Pelto | 70/413 X |
| 3,935,720 | 2/1976 | Boving | 70/276 |

*Primary Examiner*—Paul R. Gilliam
*Assistant Examiner*—Carl F. Pietruszka
*Attorney, Agent, or Firm*—Gordon Wood

[57] ABSTRACT

A door lock structure adapted to be actuated by a magnetic card key and to actuate a conventional cylindrical door lock with substantially no modification to such door lock. A housing containing the magnetically operated elements of the lock is mounted coaxially relative to the cylinder plug of the conventional lock. Insertion of a properly coded magnetic card releases a locking bar which normally holds the structure in locked position, and the entire assembly may be turned to retract the latch or dead bolt.

11 Claims, 14 Drawing Figures

FIG-1
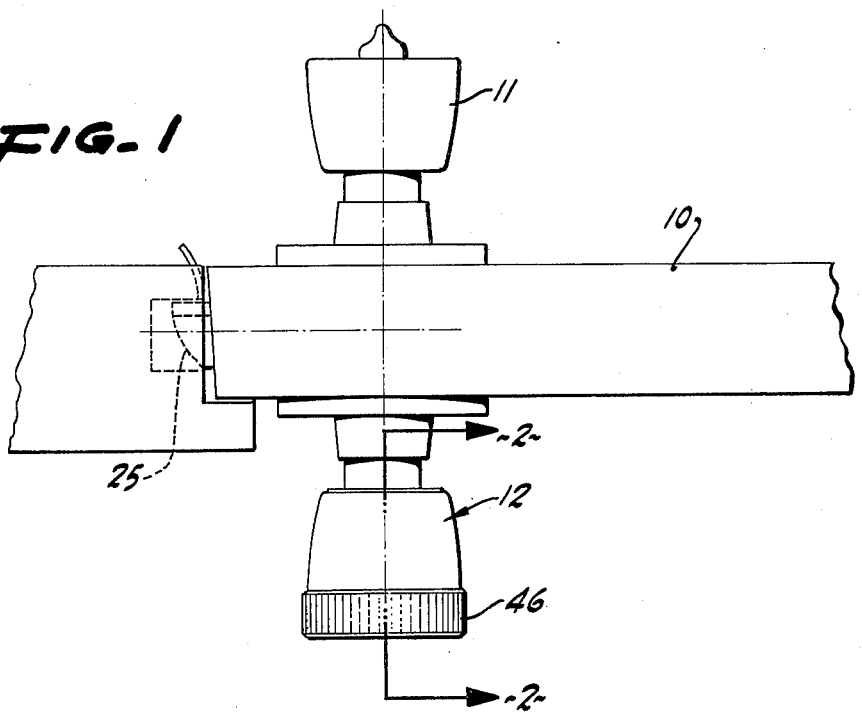
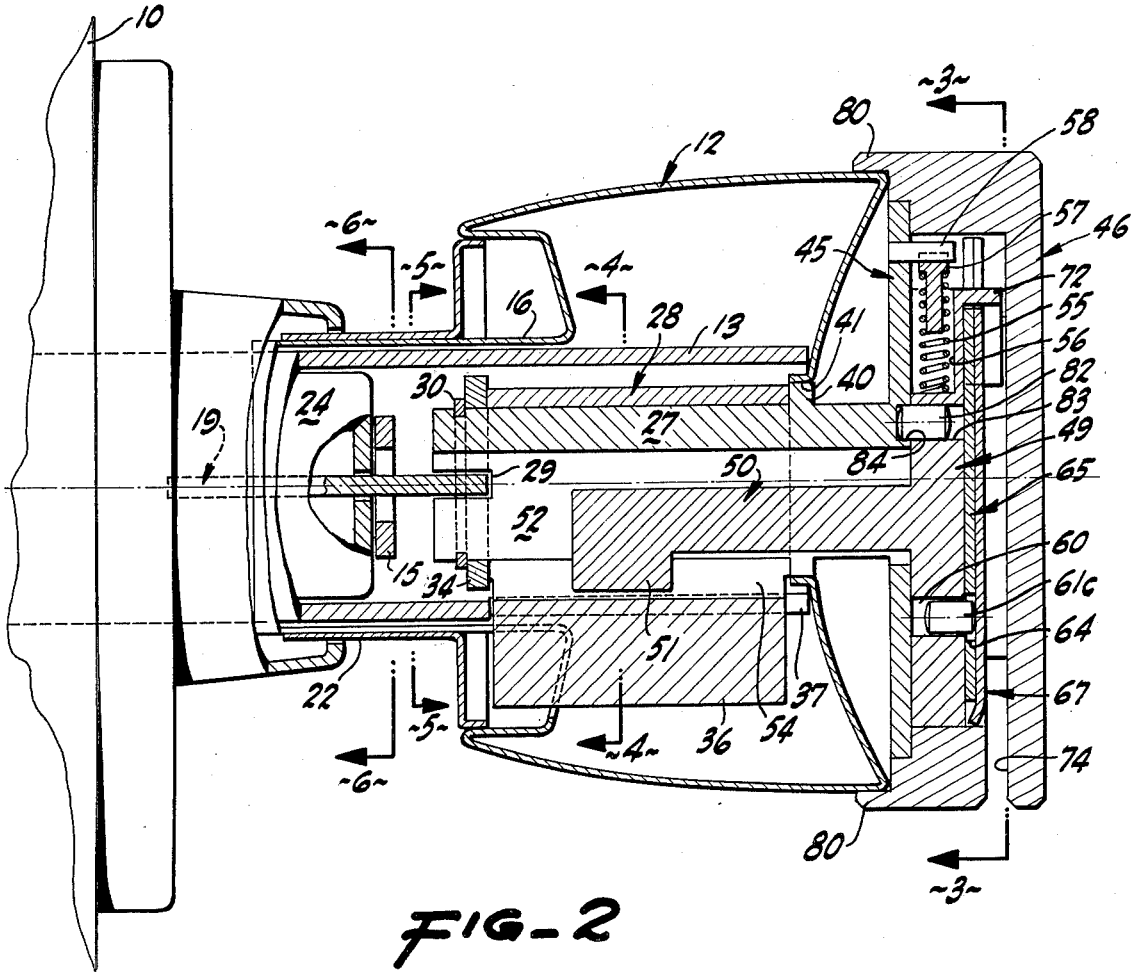
FIG-2

FIG-3
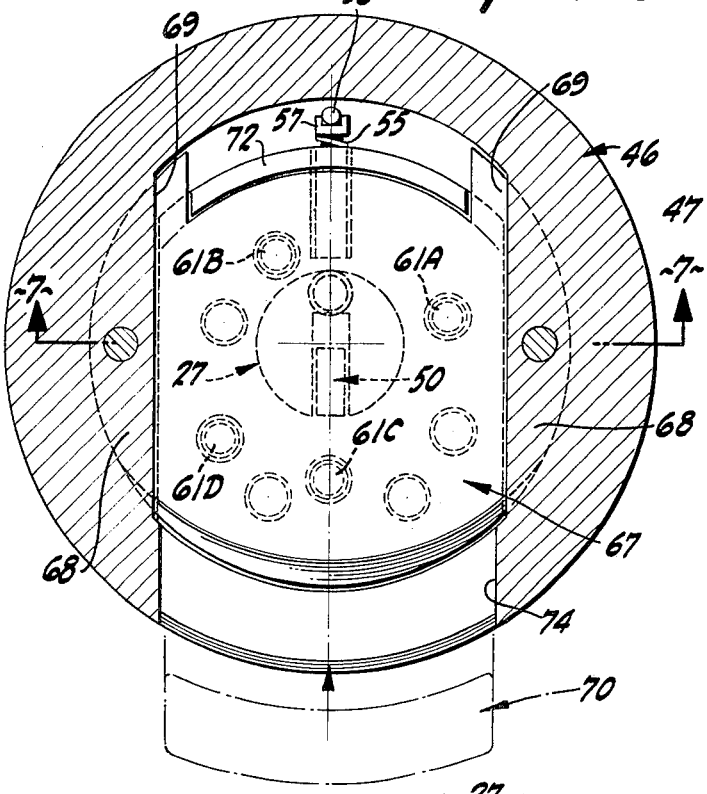
FIG-4
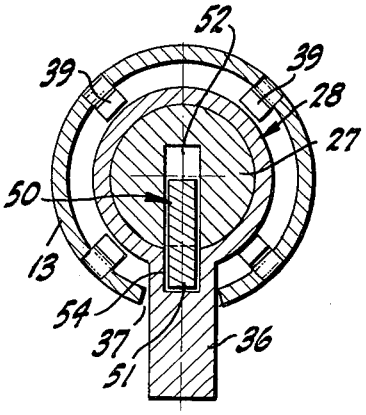
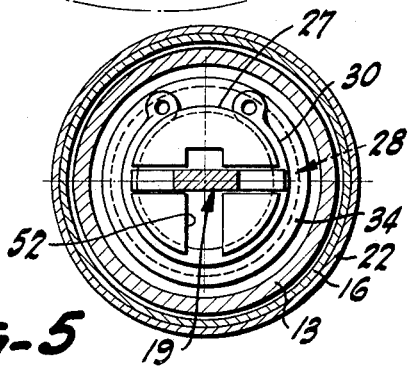
FIG-5
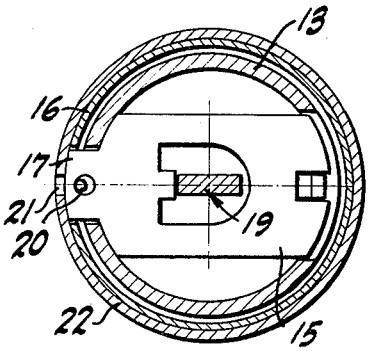
FIG-6
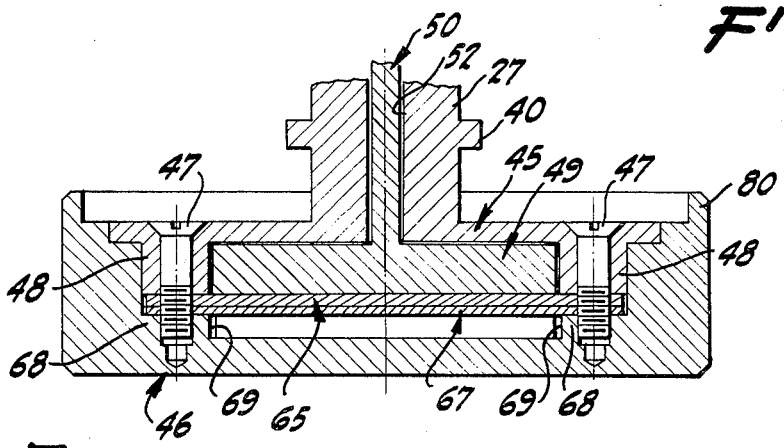
FIG-7

FIG-12
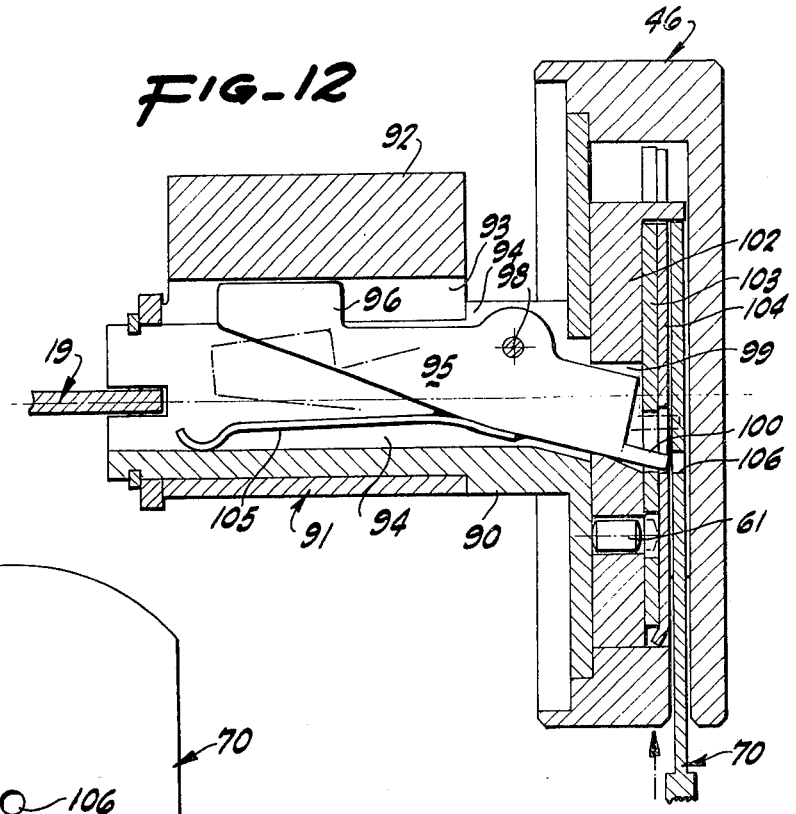
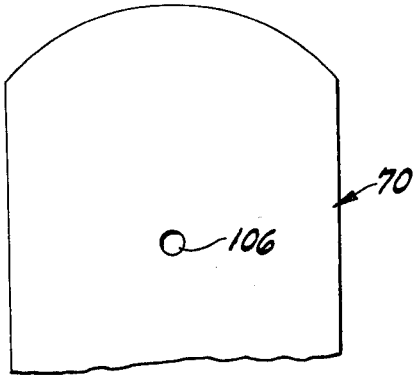
FIG-14
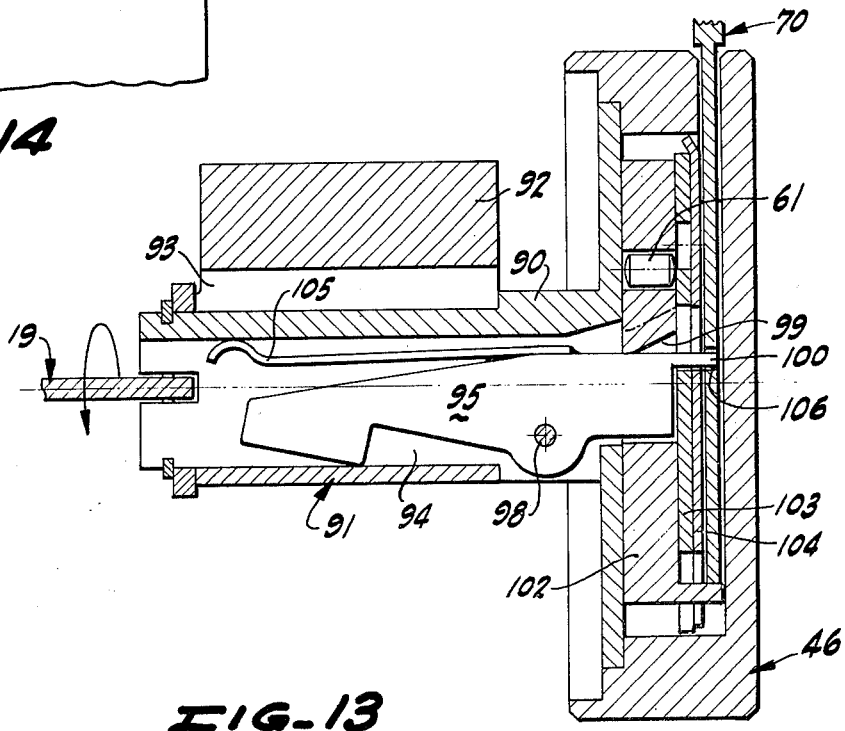
FIG-13

MAGNETIC CARD KEY OPERATED DOOR LOCK STRUCTURE

This invention relates to a lock structure operated by a magnetic card key and which structure is adapted to be employed with a conventional door lock having therein the usual pin tumbler cylinder and plug normally actuated by a conventional metal key. The main object of the present invention is the provision of a magnetic card key actuated lock adapted to be employed with a conventional outside door knob with no modification of the knob structure or dead bolt.

Heretofore several devices have been proposed for mechanically actuating a door lock by means of a magnetic card key operated mechanism. For the most part, such prior art devices have been spaced from the door lock and the latter being actuated by means of levers or linkages of some sort. All of these devices have required extensive modification of the door lock or knob to accommodate the magnetically operated device (see also for example, Allander U.S. Pat. No. 3,234,767 and lock structure marketed under the trademark MAGLOK). Most of such prior art devices have been expensive to make and none has been commercially successful. In addition, most have required the use of two hands to operate them and modifications to adapt them to left or right hand doors.

One object of the invention is the provision of a card operated magnetic lock which can be employed with a conventional cylinder lock by merely replacing the conventional pin tumbler operated cylinder and its plug by a card operated replacement cylinder and plug.

Another object of the invention is the provision of a card operated lock requiring only one hand to actuate and open the door.

Yet another object of the invention is the provision of a card operated lock which, without modification, may be installed on right or left hand doors and regardless of whether they swing in or out.

A further object of the invention is the provision of a magnetic card key operated locking device which may be incorporated in a conventional cylinder lock in the field, and marketed as a replacement part for door knob set locks. The present invention also provides a means to quickly and easily change the combination when recoding is desired.

Another object of the invention is to provide a card operated opening device which can be offered very inexpensively for houses, apartments, condominiums, hotels, office buildings, switch locks, padlocks, lockers and other containers where use of a metal key is not so desirable due to its low security and cost of replacement.

Another object of the provision of a card key operated lock structure in which the card key cannot be withdrawn from the structure except when the structure is in locked condition.

Another object of the invention is the provision of a magnetic card key operated lock having a high degree of security and wherein the magnetic locking elements cannot be moved to unlocked position by rapping the structure or by imparting impact forces by other means.

Other objects and advantages of the invention will be apparent from the following specification and from the drawings.

FIG. 1 is a top plan view of a typical door lock structure with the present invention incorporated thereon.

FIG. 2 is a greatly enlarged vertical cross sectional view of the outside door knob and associated structure as taken in a plane indicated by lines 2—2 of FIG. 1.

FIG. 3 is a vertical cross section through the knob structure as taken in a plane indicated by lines 3—3 of FIG. 2 and showing the slot for receiving the magnetic card key therein.

FIG. 4 is a vertical cross section through the knob spindle as taken in a plane indicated by lines 4—4 of FIG. 2 and showing the blocking element cooperating with the lock cylinder and its plug.

FIG. 5 is a vertical cross section through the knob spindle taken in a plane indicated by lines 5—5 of FIG. 2 and showing the means for securing the driving bar to the cylinder plug.

FIG. 6 is a vertical section through the knob spindle taken in a plane indicated by lines 6—6 of FIG. 2 and showing the knob catch.

FIG. 7 is a horizontal cross section through the housing of the invention as taken in a plane indicated by lines 7—7 of FIG. 3.

FIG. 12 is a view similar to FIG. 2 showing a modified form of the invention in which the structure is in partially unlocked position.

FIG. 13 shows the structure of FIG. 12 but with the structure in unlocked position and with the housing turned 180° from the position of FIG. 12.

FIG. 14 is a fragmentary side elevation of the card of FIGS. 12, 13 showing the hole employed to prevent withdrawal of the card when the structure is in unlocked position.

Figures 8, 9, 10, 11:
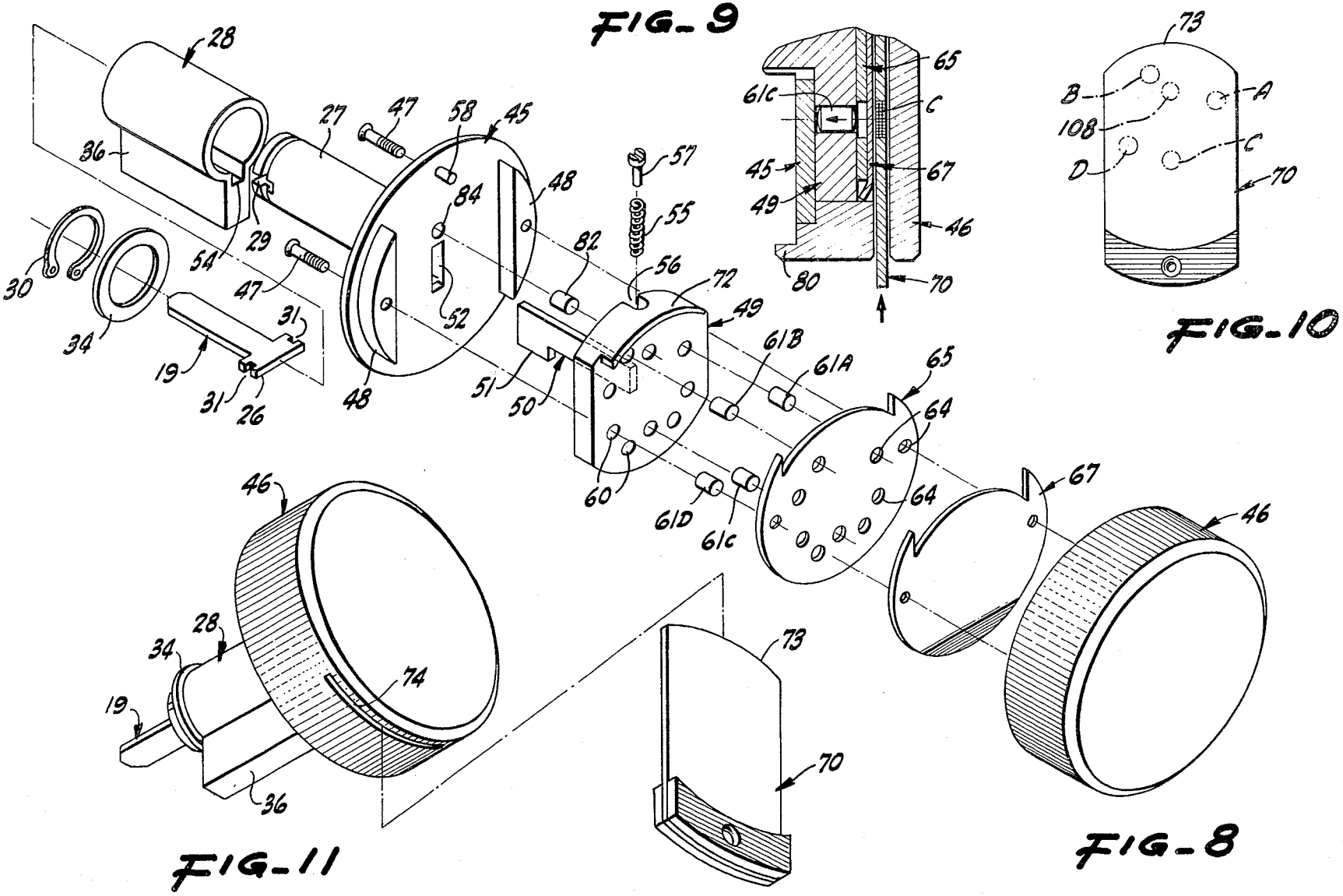
FIG. 8 is an exploded perspective of the invention.
FIG. 9 is a fragmentary vertical cross section through the housing showing a locking pin moved to unlocked position by the magnetic card key.
FIG. 10 is a side elevation of a card key with its magnetized spots indicated by dotted circles.
FIG. 11 is an exploded perspective of the complete lock assembly with the actuating card key.

In detail and first with reference to FIG. 1, the invention is adapted to be employed in a conventional door lock structure mounted on a door 10 and having an inner lock structure 11 and an outer knob 12 of the type normally having therein a locking cylinder and a plug operated by a metal key. The conventional knob 12 is secured to the outer end of the usual knob spindle 13 (FIG. 2) by means of a standard knob catch 15 (FIG. 6) which secures the tubular extension 16 of the knob 12 to the knob spindle 13 by means of an extension 17 which passes through complementarily formed holes in extension 16 and knob spindle 13 as best seen in FIG. 6. As in the conventional cylindrical lock, the driving bar indicated at 19 in FIG. 6 prevents inward movement of the knob catch 15 when the door is locked thus preventing removal of the knob 12 from the knob cylinder 13. The conventional structure also includes an elongated spring 20 which urges the knob catch 15 to its outer knob locking position shown in FIG. 6. When it is desired to remove the knob 12 the lock is unlocked, thus turning the driving bar 19 from its locking position of FIG. 6 about the central axis of the lock so as to permit depression of the knob catch 15 by means of a tool inserted through hole 21 in a tubular ferrule 22 associated with knob 12. The above described knob catch structure is conventional and no claim is made thereto except in combination with the present invention.

Also conventional, and indicated at 24 in FIG. 2, is a member 24 associated with the retracting mechanism of the lock (not shown) and which member 24 may be rotated by rotation of the driving bar 19 to retract the latch 25 (FIG. 1).

The outer end of driver bar 19 is secured to the locking plug 27 of lock cylinder 28 by the structure best seen in FIG. 8. The outer end of driver bar 19 is provided with a generally rectangular enlarged portion 26 (FIG. 8) which is received within a diametrically extending slot 29 (FIG. 5) formed at the inner end of plug 27. A snap ring 30 cooperates with a complementarily formed peripherally extending groove in plug 27 and also cooperates with notches 31 in enlarged portion 26 of the driver bar 19 to hold the latter in fixed position relative to the inner end of plug 27. Before assembly the snap ring 30 may be spaced from the inner end of cylinder 28 by means of a washer 34 as shown in FIG. 2 and FIG. 8.

The cylinder 28 of the present invention is somewhat similar to the conventional pin tumbler cylinder in that it includes a radially extending tongue 36 which is received through a slot 37 in knob spindle 13 (FIG. 4) thereby holding said cylinder against rotation. It will also be noted that said tongue 36 holds the cylinder 28 against axial outward movement relative to the knob 12 and the washer 34 and lock washer 30 hold the cylinder against axial inward movement. As best seen in FIG. 4 the cylinder 28 is also positioned radially relative to the knob 12 by a plurality of tabs 39 struck inwardly from the sidewalls of knob spindle 13.

The above mentioned plug 27 is rotatably supported within cylinder 28 and, as best seen in FIG. 2, is provided with an annular flange 40 adapted to fit within the standard central opening 41 in knob 12. Said flange 40 and the above described washer 34 act to prevent axial movement of the plug 27 relative to the cylinder 28.

Integrally formed with plug 27 at its outer end is a nonmagnetic plate 45 (FIGS. 7,8) which is preferably circular and which is adapted to be secured to a housing generally designated 46 by means of screws 47 (see FIG. 7). Housing 46 is formed of steel or other magnetizable material. The shape of plate 45 is best seen in FIG. 8 wherein it will be noted that said plate is provided with a pair of integral guides 48 adapted to slidably receive therebetween a nonmagnetic block 49 (FIG. 8) which has integrally secured thereto at its inner face a blocking bar 50 which extends inwardly from block 49 and is received within a slot 52 in plug 27. When the structure is in its locked position an offset portion 51 of blocking bar 50 is also received in a slot 54 in the tongue 36 of cylinder 28. By this structure, rotation of plug 27 relative to the cylinder 28 is prevented thereby holding the lock in locked condition.

The blocking bar 50 is spring urged to its locked position of FIG. 2 by means of a compression spring 55 which is received at one end within a groove 56 formed in block 49 and which spring at its other end receives a fitting 57 which in turn abuts against a pin 58 extending laterally outwardly from plate 45.

The block 49 is provided with a plurality of holes or cavities 60, each of which is adapted to receive therein an axially slidable magnetic locking pin 61, the opposite ends of which are magnetized with opposite polarities.

When the structure is in locked position, said pin 61 is adapted to be attracted outwardly of the cavity 60 by steel housing 46 and into corresponding holes 64 in a nonmagnetic locking plate generally designated 65. This locking plate is fixedly secured relative to the housing 46 by the screws 47 (FIG. 7).

In their locked position, the pins 61 are adapted to abut another plate 67 of nonmagnetic material such as aluminum and which plate retains the pins 61 in holes 64. This plate 67 is also secured relative to the housing 46 by means of the screws 47 (FIG. 7).

Plate 67 is spaced apart from the outer side of housing 46 by means of a pair of bosses 68 (FIG. 7) which are formed to provide inner parallel sides 69 (FIG. 3) which act as guides for the magnetic card key generally designated 70 (FIG. 10). As best seen in FIG. 8 the block 49 is provided with a curved flange 72 at its upper end which is adapted to be engaged by the upper curved edge 73 of card key 70. To permit insertion of the card key 70, the lower side of housing 46 is provided with a slot 74 which is substantially in continuation of the side edges 69 of bosses 68. As best seen in FIG. 8 the upper edges of plate 65 and 67 are cut away to permit vertical sliding movement of the flange 72 on block 49.

Although the particular number and arrangement of holes 60 in block 49 and the particular arrangement of locking pins 61 is not important to the present invention, four such locking pins are shown in FIG. 8 and designated 61A-61D. Also in FIG. 10 the appropriate magnetized spots A-D are indicated in positions corresponding to the positions of the four locking pins. When the card 70 is inserted upwardly into the housing 46 with the upper edge 73 engaging flange 72 of block 49, the magnetic spots on the card key cause the pins 61 to be repelled into the block 49 out of the locking holes 64 in locking plate 65 thereby permitting the block 49 to be moved upwardly against the resiliency of spring 55. This movement retracts the offset portion 51 of blocking bar 50 out of the slot 54 in cylinder 28 thereby permitting the plug 27 and driver bar 19 to be rotated relative to the cylinder 28 by turning housing 46 to retract the latch 25.

It will be noted that in the normal locked condition, the locking pins 61 are attracted to the locked position of FIG. 2 by the housing 46 which is formed of any suitable magnetic material such as steel. This allows the horizontal movement of the magnet pins which might not return to locked position without the attraction to the steel housing. The housing 46 further shields the magnets from devices which might determine their position and polarity to affect decoding, or demagnetization or picking of the lock.

It will be apparent that the slot 74 may be placed on the upper side of housing 46 and the other cooperating elements reversed from the position shown in FIG. 2. However, by having the slot 74 open downwardly, dust and other foreign material is excluded from the device. The card slot 74 may also be positioned to open horizontally outwardly by cutting the slot 54 in the sidewall of cylinder 28 instead of in tongue 36.

In order to provide a good connection between the housing 46 and the knob 12 about which the former rotates, it is preferable to provide said housing with an axially extending peripheral lip 80 as best seen in FIG. 2. By this structure the housing 46 is rotatably supported somewhat by the outer periphery of knob 12, also foreign material is excluded from between the lock and the housing of this invention.

Since the structure, in its locked position, depends on pins 61 being received in locking plate 65, it might be possible, though quite improbable, to move the pins inwardly to their unlocked position in block 49 by rapping or otherwise impacting the outer face of housing 46 so that the structure may be unlocked by inserting a blank card in the slot 74 and thrusting it against flange 72, while at the same time applying an impact force to the outer face of said housing 46. This method of circumventing the normal operation of the lock may be prevented by providing an antirap magnetic pin 82 slidably supported in a bore 83 in block 49. This pin 82 is adapted to be received at its inner end in a recess 84 in plate 45 (FIG. 2). Pin 82 normally abuts plate 65 but is not aligned with a hole therein. This pin 82 is magnetized so as to be normally attracted toward the outer end of steel housing 46. However, if an axially directed impact is applied to the outer face of housing 46 to move the pins 61 to the left as seen in FIG. 2, such impact will also have the effect of moving the pin 82 to the left into recess 84. In this manner translation of the block 49 upwardly as seen in FIG. 2 is prevented, thus preventing unlocking of the block.

Although not required, the card key (FIG. 10) may include a magnetic spot 108 to attract magnetized pin 82 and assure that said pin 82 will not be repelled into locking position in recess 84 of plate 45, or the card can be encoded so that if inserted incorrectly magnetic pin 82 will be repelled to lock the lock.

A modified form of the invention is shown in FIGS. 12–14 and which form incorporates improved features over the structure hereinbefore described. In this case, the plug 90 is also rotatably supported within cylinder 91 which includes an elongated tongue 92 in which is formed an axially extending slot 93.

The plug 90 is provided with a longitudinally extending slot 94 in which is received an elongated lever 95 which is formed at one end with an inner portion 96 which is adapted to be received in slot 93 of cylinder 91 to prevent rotation of plug 90 relative to said cylinder 91. The lever 95 is swingably mounted relative to plug 90 by means of a pivot pin 98 secured in plug 90. The outer end of lever 95 is formed to provide a pin-like projection 100 for a purpose to be described.

Received within housing 46 is a sliding block 102 similar to sliding block 49 of the previously described embodiment. Cooperating with sliding block 102 is a blocking plate 103 and a plate 104 similar to plates 65, 75 respectively of the previously described embodiment.

The sliding block 102 is provided with a central opening 99 for receiving the outer end of lever 95 therethrough and the plates 103, 104 are also provided with appropriately shaped openings as indicated in FIG. 12 for receiving the pin-like projection 100.

In this case the card key 70 is provided with an aperture 106 for receiving therein the pin-like projection 100 on lever 95.

The lever 95 is normally urged to its locking position shown in full lines of FIG. 12 by means of elongated flat spring 105 which is fixed at one end to the lever 95 and abuts the inner end of slot 94 in plug 90. Lever 95 thus urges block 102 to its locked position. When the card key 70 is inserted in the housing 46 thereby urging the locking pins 61 to unlocked position, upward movement of the card 70 translates block 102 and results in pressure from the bottom of opening 99 on lever 95 swinging the same to the unlocked position shown in dot-dash lines of FIG. 12. This swinging movement of lever 95 causes the pin-like projection 100 to be received in hole 106 in card 70 thereby preventing the removal of said card during the rotation of plug 90 in cylinder 91 and until the lever 95 has been swung back to its locking position. This is an important feature since it would be undesirable to permit removal of the card 70 while the structure is in unlocked position.

Opening of the door is effected as in the previously described embodiment by rotating the housing 46 approximately 180° to the position shown in FIG. 13. Upon reversing the movement of housing 46 to the original locked position of FIG. 12, it is then possible to remove the card 70.

Although shown in conjunction with a door knob lock, the invention may be utilized wherever similar metal key locks are employed, such as in dead bolts and padlocks. Minor modifications to the driver bar assembly and its attachment to the plug may be required as obvious in the art.

The magnet pins may be easily changed in position and polarity to make new combinations as described in my U.S. Pat. RE. No. 27753 and the card is constructed and operates as described in my U.S. Pat. No. 3,611,763.

I claim:

1. In a lock structure that includes a pair of relatively rotatable members, a blocking element engageable with said members to prevent such relative rotation when said structure is locked, said element being movable from a locked position preventing such movement to an unlocked position permitting such movement;

means for actuating said structure comprising:

a housing mounted on one of said members, a movable block mounted in said housing and operatively connected with said blocking element, a door knob fixedly secured to one of said members, said other member being a plug rotatably supported in said one member, a locking magnet in said block normally holding said block fixed relative to said housing and movable to an unlocked position under the influence of a magnetic key inserted in said housing to allow movement of said movable block by said key to said unlocked position thereby permitting relative rotation of said members to unlock said structure.

2. A structure according to claim 1 wherein said housing is positioned outwardly of said door knob and in axial alignment therewith.

3. A structure according to claim 1 wherein said plug is fixedly secured at its outer end to said housing and said blocking element is fixedly secured at its outer end to said movable block.

4. A structure according to claim 3 wherein said blocking element comprises an elongated bar fixedly secured at its outer end to said block, said plug and said one member being formed with registering longitudinally extending slots for receiving the inner end of said bar therein when said structure is locked.

5. A structure according to claim 4 wherein said block is mounted for sliding movement diametrally of the axis of said knob to permit said bar to be wholly received in the slot of said plug and to permit said relative rotation to unlock the structure.

6. A structure according to claim 1 wherein said blocking element is pivoted on said plug for swinging movement relatively thereto.

7. A structure according to claim 1 wherein one of said members is a lock cylinder and the other of said members is a plug rotatable in said cylinder.

8. A structure according to claim 7 wherein said blocking element is a lever swingably supported on said plug and adapted at one end to engage said cylinder when in said locked position.

9. A structure according to claim 8 wherein said lever is adapted at its opposite end to engage such card key when said lever is in unlocked position.

10. A structure according to claim 8 wherein said lever is engageable with said card key and adapted to be swung by the latter to an unlocked position out of engagement with said cylinder.

11. A structure according to claim 8 wherein said cylinder and plug are provided with axially extending registering slots, said lever being supported within a slot in said plug and adapted at said one end to be received in the slot in said cylinder when the structure is locked.

* * * * *